United States Patent [19]

Milberger et al.

[11] Patent Number: 4,534,583

[45] Date of Patent: Aug. 13, 1985

[54] MUDLINE CASING HANGER ASSEMBLY

[75] Inventors: Lionel J. Milberger; Jimmy R. Martin; Thomas P. Mataway, all of Houston, Tex.

[73] Assignee: Combustion Engineering, Inc., Windsor, Conn.

[21] Appl. No.: 441,190

[22] Filed: Nov. 12, 1982

[51] Int. Cl.[3] ..... F16L 35/00

[52] U.S. Cl. ..... 285/24; 285/141; 285/322

[58] Field of Search ..... 285/140, 141, 142, 143, 285/24, 27, 322

[56] References Cited

U.S. PATENT DOCUMENTS

| | | | |
|---|---|---|---|
| 3,727,952 | 4/1973 | Richardson | 285/322 X |
| 3,741,589 | 6/1973 | Herd et.al. | 285/141 X |
| 4,222,507 | 12/1983 | Reimert | 285/141 X |
| 4,276,932 | 7/1981 | Saliger et al. | 166/214 |
| 4,408,783 | 10/1983 | Gruller | 285/24 X |
| 4,468,055 | 8/1984 | Reimert | 285/141 |

*Primary Examiner*—Dave W. Arola

*Attorney, Agent, or Firm*—Edward L. Kochey, Jr.

[57] ABSTRACT

A casing hanger assembly with a collet (16) initially pulled down with latch (26) engaging cage (25). On entry in the casing (52) the push shoulder (44) is engaged and the latch released. The load shoulder (22) is not used for other than its load carrying duty. Engagement is assured by taper (40), and alignment by pins (50, 51).

23 Claims, 7 Drawing Figures

MUDLINE CASING HANGER ASSEMBLY

BACKGROUND OF THE INVENTION

This invention relates to oil and gas well casing hanger apparatus and in particular to a casing hanger assembly for supporting the casing at the mudline of a subsea well.

In the drilling of oil and gas wells concentric casing strings are hung and cemented in place as the drilling progresses to increasing depths. When drilling a subsea well from a fixed platform it is desirable to support the casing weights from the mudline with a blowout preventer located at the platform. Risers extend from the blowout preventer to the support location of substantially the same size as the casing string itself.

In supporting additional casing within the previously-run string, a limited annular space is available for this support. Furthermore, the support must be arranged in such a way as to permit flow through the annular space to facilitate cementing operations.

It is known to run the new casing hanger with its string of casing with a diametrically compressible collet around it being urged outwardly. The collet includes specially-shaped support shoulders extending outwardly which engage grooves in the previously-set hanger body. The new casing hanger body then rests on this collet.

Means such as shear pins are required to carry the collet on the hanger body at least until it enters the casing below the BOP and sometimes to pull the collet down until it reaches the support elevation. Other systems use the load support shoulder to push the collet down after means are provided to constrain the collet until it enters the casing string.

As wells approach greater depths, increasing load must be carried through these hangers; and effective utilization of the available space and material with structures having minimum stress concentrations is desirable. The load supporting segments which enter the previously-run hanger body should be fully engaged despite any mud that may have previously accumulated therein. Furthermore, the load shoulder between the collet and the newly-run casing hanger body is preferably shaped to provide the most desirable stress distribution in the hanger body.

The collet and hanger body should be removable in the event that removal of the casing string is required, and a fluid flow return path of reasonable size should be provided past the collet through the annular space.

It is also desirable where possible to avoid shear mechanisms which will leave loose metal particles that end up falling down hole.

SUMMARY OF THE INVENTION

A casing hanger assembly for supporting a casing string within and from a previously-run hanger comprises a cylindrical casing body surrounded by a diametrically compressible collet. The casing body has a downwardly-facing load shoulder around a substantial majority of the periphery and a first reduced diameter portion below the load shoulder. It also has a second and smaller reduced diameter portion below the first reduced diameter portion. Within the lower reduced diameter portion there is an intermediate section extending outwardly and having a downwardly-facing push shoulder. On the hanger body, a latch engaging means is secured outwardly of the second reduced diameter portion and at the lower end thereof.

The collet surrounding the casing body is movable axially between the load shoulder and the latch engaging means. The collet has the support segments at the upper end which are engageable with the previously-run hanger body. There is an upwardly-facing load shoulder at the top of the collet adapted to engage the downwardly-facing load shoulder of the casing hanger body. This shoulder is preferable at an angle of between 20 and 40 degrees from the horizontal to provide optimum stress distribution in the hanger body.

The collet also has outwardly-extending latches at the lower end of the collet which are engageable with the latch engaging means when the collet is in its expanded condition but not when it is in its diametrically compressed condition. The outer cylindrical surface of the collet has a first vertical flat at a first diameter with an inwardly-tapering portion therebelow. The collet has a second vertical flat with a greater diameter and a tapering portion joining the first and second flats. The collet also has an inwardly-extending, upwardly-facing shoulder at the lower end which is engageable with the push shoulder of the hanger body.

The collet is installed on the hanger body before running the casing string with the latch engaged in the latch engaging means and with the collet at its fully-expanded condition. The hanger body and collet after progressing through the BOP enters the casing string wherein the collet is compressed by engagement between the casing which it is entering and the outer edge of the collet.

The previously-described features are sized such that when the casing is squeezed along the lower tapered surface to a diameter of the lower or second flat, the latch is not yet released from the latch engagement means but the inwardly-extending, upwardly-facing shoulder has formed a diameter less than that of the push shoulder. When the casing is reduced with the second flat entering the casing, the latch is free of the engaging means and the casing hanger body pushes the collet down by means of the shoulder of the intermediate section. Accordingly, the transfer of collet movement from the latch to the shoulder is accomplished as the taper between the first and second flats enters the casing. This avoids excessive rose petaling effect as the bottom end of the collet is squeezed and ensures that the push shoulder will fulfill its function after the latch disengages.

Since the load support shoulder is not being used to push the casing downwardly, it may be tapered from the horizontal as desired to obtain the minimum stresses in the hanger body. Were such a tapered shoulder to be used in a system which pushes the hanger down with the shoulder, the rose petaling effect in entrance could result in a collet being outwardly of the support location as it engages the pushing surface. As the collet tries to return to the cylindrical shape, the tapered surface could cause the collet and hanger body to bind and possibly lock up entirely.

In prior art systems where the collet is being pushed down by its load surface, a substantially horizontal section is required as the hanger pushing shoulder between the reduced area section where the collet is compressed and the fully-expanded area where the collet is expanded. If the engagement openings at the support location are partially blocked, the collet may not spring out far enough to clear these shoulders. The use of the auxiliary pushdown shoulder of this invention frees the location between the reduced and expanded diameter sections so that is gradual and uniform taper may be used through substantially all radial difference. Accordingly, an uninterrupted and substantial force is available to expand the collet through interaction of the casing weight along this tapered portion.

The preferred embodiment of the collet is one of a sinuous form wherein the cylindrical form has alternating part length slots from the top and bottom. Alignment pins located on the casing hanger body engage the bottom opening slots to maintain alignment of the collet with respect to the casing hanger body. Flow slots may then be located in the casing hanger body at the load support location, and alignment with the upper slots of the maximum flow by area is thereby achieved without losing any load support surface.

With the preferred collet, alignment pins may be located diametrically opposite one another since the collet has no circumferential movement as compared to the less desirable C-shaped collet.

It is furthermore preferred that the shoulder of the casing hanger body be located with respect to the latched collet below the tapering portion between the first and second flats. This further assures the interchange in collet pull down action between the latch and the push shoulder without fear of disengagement because of rose petaling and possible jamming at that time.

DESCRIPTION OF THE PREFERRED EMBODIMENT

Figure 1:
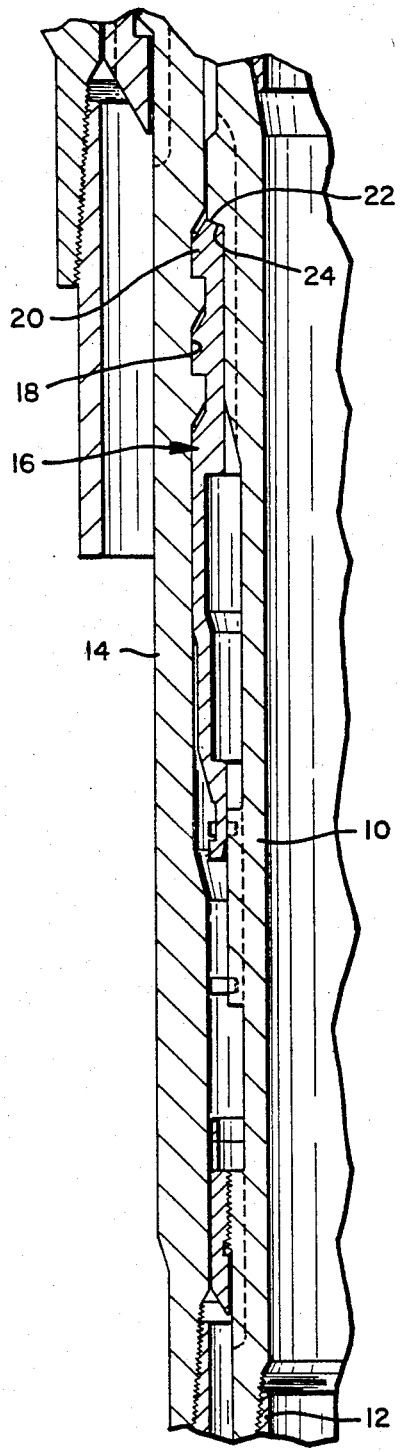
FIG. 1 is a sectional elevation showing the casing hanger assembly in the fully landed position.

A casing hanger body 10 is intended to support a string of casing 12 from a tubular member such as a previously-run hanger 14. The hanger body 10 along with collet 16 forms a casing hanger assembly. Load supporting grooves 18 mate with the support segments 20 of the collet for supporting the collet within the earlier landed casing hanger 14. The casing hanger body 10 is supported on load shoulder 22 of the collet by load shoulder 24 of the hanger body.

Figure 2:
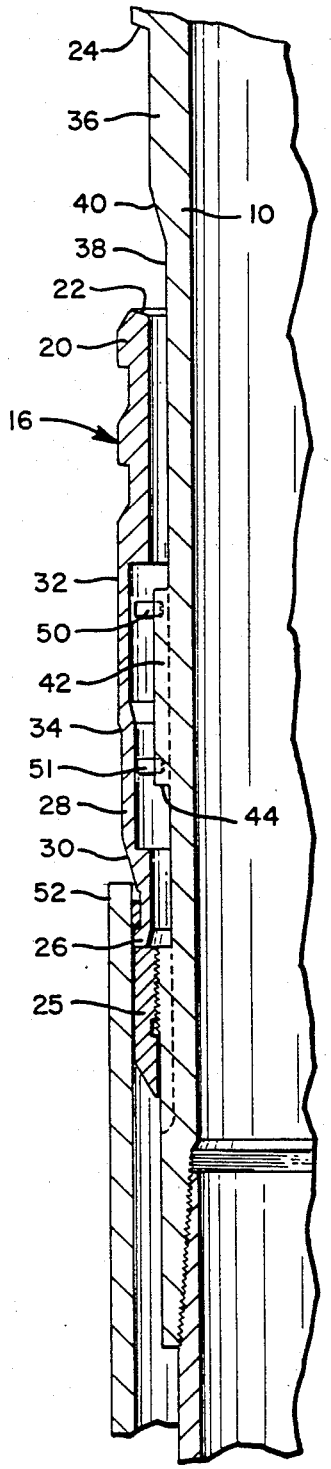
FIG. 2 illustrates the assembly approaching the entrance to the casing.

As illustrated in FIG. 2, a latch engaging means such as cage 25 is screwed onto threads located near the bottom of the casing hanger body. The collet 16 has latches 26 located at the lower end which engage the cage 24 with the collet in its expanded condition shown in FIG. 2. These outwardly-extending latches engage with the cage in the expanded condition but as described later, they will not in the diametrically compressed condition.

The collet has a first vertical flat 28 with a first diameter and an inwardly-tapering portion 30 therebelow. The collet has a second vertical flat 32 of a greater diameter with a tapering portion 34 joining the first and second flats.

The cylindrical casing body 10 has a first reduced diameter portion 36 below the load shoulder 24. There is a second smaller reduced diameter 38 below the first reduced diameter portion and a tapered portion 40 joining the first and second reduced diameter portions. Located within the second reduced diameter portion, there is an intermediate section 42 extending outwardly and having a downwardly-facing push shoulder 44. The cage 24 is secured below this elevation.

Figure 6:
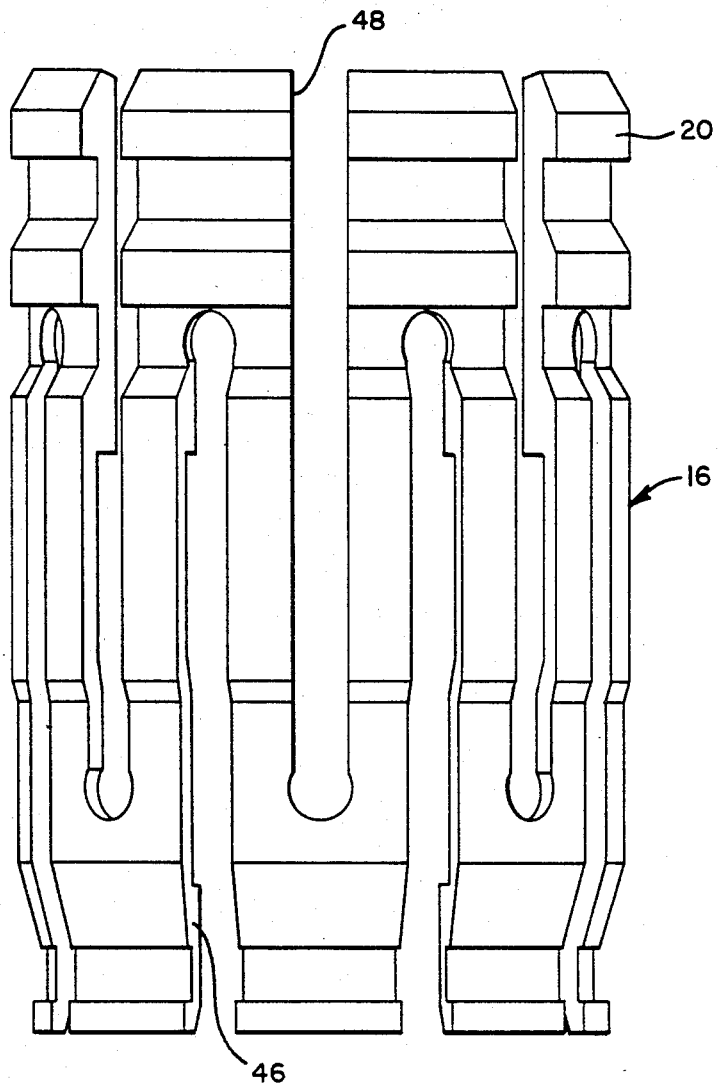
FIG. 6 illustrates the preferred sinuous-type collet.

The preferred collet is of the form illustrated in FIG. 6 with downwardly-opening slots 46 and upwardly-opening slots 48. Alignment pins 50 and 51 are located on the intermediate section 42 with the collet aligned so that the pin 51 is extending into slot 46. Pin 50 is located directly above pin 51 and two similar pins are preferably located at two other diametrically separated locations.

Figure 3:
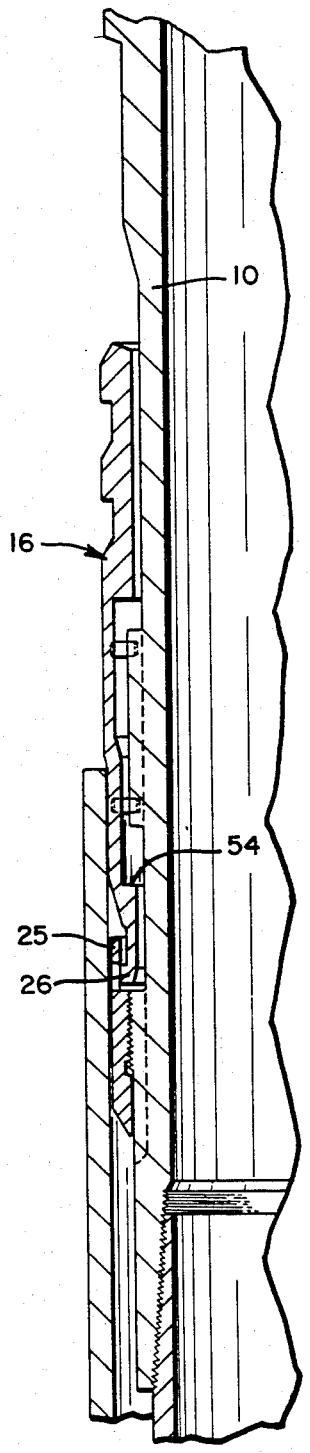
FIG. 3 illustrates the assembly entering the casing.

As the collet enters casing 52, the interaction on tapered surface 30 diametrically squeezes the collet so that as flat 28 engages the casing, it is reduced to the diameter illustrated in FIG. 3. An upwardly-facing, inwardly-extending shoulder 54 on the collet is moved inwardly so that the diameter of this shoulder is less than that of the downwardly-facing shoulder 44 of the casing hanger. Also, latch 26 has not yet become disengaged from the cage 25. Should the collet rose petal (spread at the top because of being squeezed near the bottom) and should this happen sufficiently for the latch to disengage, it can be seen that shoulder 54 will move inwardly even beyond the position shown thereby assuring engagement with push shoulder 44. For further assurance, however, the flat 28 is extended upwardly so that in the latched position, it extends beyond the push shoulder 44.

Figure 4:
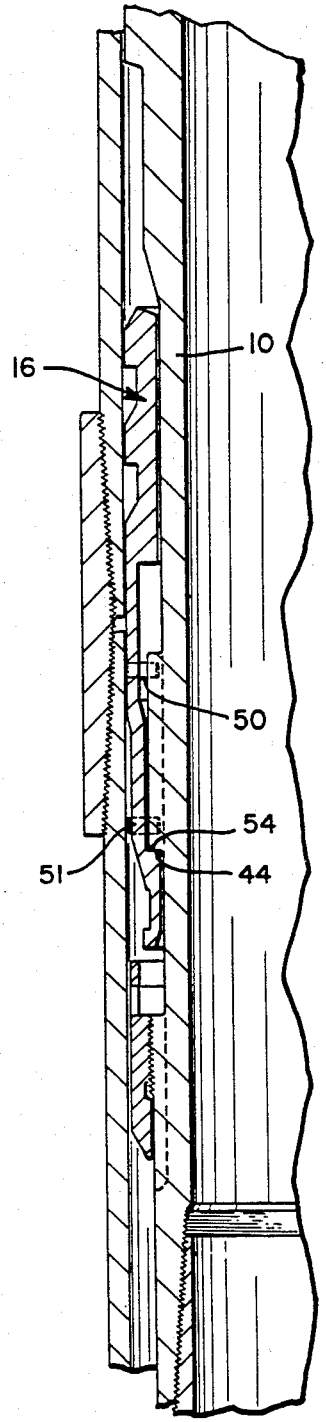
FIG. 4 illustrates the assembly running through the casing string.

As the hanger is further lowered within the casing, taper 34 rides against the casing 52 until flat 32 is located within the casing as shown in FIG. 4. During this operation, the latch 26 disengages from cage 24; and the hanger body 10 moves downwardly with respect to the collet 16 so that push shoulder 44 operates against shoulder 54 to push the collets down through the casing. During this squeezing operation, alignment pin 50 moves into engagement with slot 46 of the casing hanger. The entire collet at this time is diametrically reduced close to the surface of reduced diameter portion 38 of the casing hanger body.

As the hanger reaches the support elevation, the support segments 20 find the mating openings in the previously-set hanger body, and the collet springs outwardly to its engaged position. This simultaneously frees the lower end of the collet from the push shoulder 54 so that the hanger body may move further down with respect to the collet. There is no dependency on shear members to release the collet and, therefore, no shock loading in setting the hanger.

Should anything be located in the grooves to interfere with the expansion of the collet, the gradual and full-length taper 40 operates to urge the collet outwardly and into complete engagement. Since this taper extends the full length of the difference in diameters, it can be seen that even though one of the segments should be completely blocked, there is no possibility of it hanging up on the casing hanger body at this location.

The collet is designed to spring free of the push shoulder 44; but should this inadvertently fail to come completely loose, the members will deform or shear diagonally at this location since they are not designed to carry the heavy load. Furthermore, the surfaces could be tapered to assure their disengagement. This will not interfere with the pushing action since very little force is required to push the collet down the casing after it is deformed inwardly. Should there be a frictional engagement tending to hold the lower end of the collet in, lifting the weight slightly would free up the shoulder.

Figure 5:
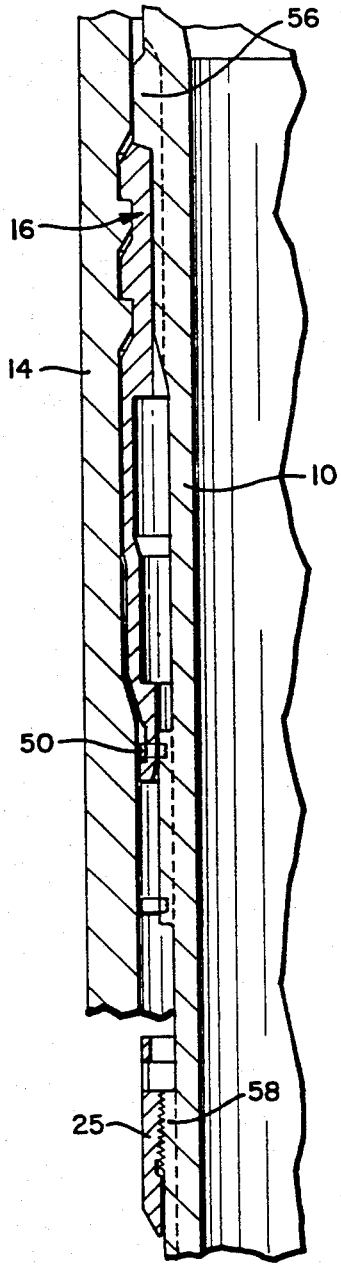
FIG. 5 illustrates the assembly fully landed.
Figure 7:
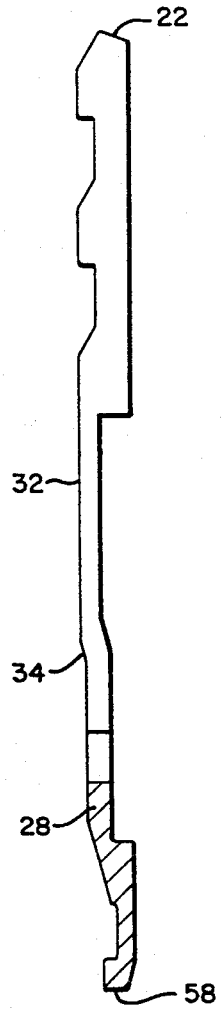
FIG. 7 is a side elevation through a leg thereof.

The collet thereby expands into the position shown in FIG. 5 with the casing hanger moving downwardly and the first diameter 36 moves into position to back up the collet. The upper alignment pin 50 remains in engagement with slot 46 so that the predetermined alignment between the collet 16 and the hanger body 10 is maintained.

Flow by slots 56 are milled in the hanger body at the locations of slots 48 of the collet. This facilitates flow by during cementing of the casing string without reducing any of the load bearing surface between the collet and the casing hanger body. Furthermore, flow by slots 58 are milled at the lower portion of the casing hanger to permit flow by the cage 25. The load shoulders 22 and 24 are tapered at an angle from the horizontal of between 20 and 40 degrees. This provides a lower stress in the casing hanger body because the load transfer path is off the vertical, and the taper also increases the angle at the internal edge of the shoulder, reducing the stress concentration. Since the push down of the casing after release of the latch is done by push shoulder 44, there is no constraint on the design of the load support shoulder 24 or on the taper 40, as would be imposed if either of these performed the function of pushing it down.

Each latch 26 has a square or horizontal lower edge 58. This prevents premature engagement of the latch 26 and cage 25 if the hanger body 10 is raised. On raising the hanger body the cage will abut the lower edge 58 of forcing the collet 16 up until it is compressed. After compression of the collet the latch 26 cannot engage the cage 25. The casing may, therefore, be removed if necessary, or reciprocated for cementing without the latch inadvertently engaging.

We claim:

1. A casing hanger assembly for supporting a casing string within and from a tubular member comprising:

a vertically oriented cylindrical casing hanger body having, a downwardly-facing load shoulder around a substantial protion of the periphery, and having a major diameter, a first reduced diameter portion below said load shoulder, a second and smaller reduced diameter portion below said first reduced diameter portion, an intermediate section within said second reduced diameter portion extending radially outwardly and having a downwardly-facing push shoulder, a latch engaging means secured radially outwardly of said second reduced diameter portion at the lower end thereof;

a diametrically compressible collet surrounding said casing body movable vertically between said load shoulder and said latch engaging means having, radially outwardly extending support segments at an upper location on said collet for mating and supporting said collet from said tubular member, an upwardly-facing load shoulder above said support segments adapted to engage said downwardly-facing load shoulder, radially outwardly-extending latches at the lower end of said collet engageable with said latch engaging means in the relaxed extended condition but not in the diametrically compressed condition, whereby said collet is engaged with said latch engaging means until it is compressed, said collet having a first and vertical flat on its outer diameter with a first diameter and having a radially inwardly-tapered portion therebelow, said collet having a second vertical flat on its outside diameter at a greater diameter than that of said first vertical flat and above said first vertical flat with a tapering portion joining said first and second flats, said collet having a radially inwardly extending upwardly facing shoulder at the lower end engageable with said push shoulder;

the diameter of said first and second flats, said latch, said latch engaging means, said push shoulder and said inwardly-facing shoulder sized such that as said collet enters a casing and is diametrically reduced by squeezing the collet to the casing diameter the reduction of said first flat to the casing diameter produces a smaller diameter of said inwardly-facing shoulder than the diameter of said push shoulder but does not release said latch from said latch engaging means, and reduction of said second flat to the casing diameter fully releases said engaging means;

whereby said latch is disengaged as the taper joining said first and second flats enters the casing and said push shoulder thereby engages said collet to push the collet down the casing to the support elevation.

2. A casing hanger assembly as in claim 1 said casing hanger body having a tapered portion joining said first and second reduced diameter portions throughout substantially the entire differential diameter.

3. A casing hanger assembly as in claim 1 having said load shoulders tapered so that the surface forms an angle with the horizontal of between 20 and 40 degrees.

4. A casing hanger assembly as in claim 1 having vertical slots in said collet, alignment pins secured to said casing hanger body and passing through said slot, additional slots in the upper end of said collet, slots in said casing hanger body through said load shoulder alignable with the slots in said collet, said alignment pins and slots in the collet arranged so that the upper slots in the collet are aligned with the slots in the hanger body.

5. A casing hanger assembly as in claim 4 wherein the pins are axially separated.

6. A casing hanger assembly as in claim 5 wherein said pins are located on said intermediate section of said casing body.

7. An apparatus as in claim 5 wherein alignment pins are located at a plurality of diametrically separated locations.

8. A casing hanger assembly as in claim 1 wherein said push shoulder is located below the tapering portion of said first and second flats of the collet when said collet is latched into engagement with said latch engaging means.

9. A casing hanger assembly as in claim 1 wherein said collet is formed of a cylindrical section having alternating part length slots from the top and bottom.

10. A casing hanger assembly as in claim 9 said casing hanger body having a tapered portion joining said first and second reduced diameter portions throughout substantially the entire differential diameter.

11. A casing hanger assembly as in claim 10 having,
alignment pins secured to said casing hanger body and passing through at least one of said slots open at the bottom,
slots in said casing hanger body through said load shoulder alignable with the slots in said collet which are open at the top,
said alignment pins and slots in the collet arranged so that the upper slots in the collet are aligned with the slots in the hanger body.

12. An apparatus as in claim 11 wherein alignment pins are located at a plurality of diametrically separate locations.

13. A casing hanger assembly as in claim 12 wherein the pins are axially separated.

14. A casing hanger assembly as in claim 13 wherein said pins are located on said intermediate section of said casing body.

15. A casing hanger assembly as in claim 14 having said load shoulders tapered so that the surface forms an angle with the horizontal of between 20 and 40 degrees.

16. A casing hanger assembly as in claim 15 wherein said push shoulder is located below the tapering portion of said first and second flats of the collet when said collet is latched into engagement with said latch engaging means.

17. A casing hanger assembly for supporting a casing string within and from a tubular member comprising:
a vertically extending cylindrical casing hanger body having,
a downwardly-facing load shoulder around a substantial portion of the periphery, and having a major diameter,
a first reduced diameter portion below said load shoulder,
a second and smaller reduced diameter portion below said first reduced diameter portion,
an intermediate section within said second reduced diameter portion extending radially outwardly and having a downwardly-facing push shoulder,
a latch engaging means secured radially outwardly of said second reduced diameter portion at the lower end thereof;
a diametrically compressible collet surrounding said casing body movable vertically between said load shoulder and said latch engaging means having,
radially outwardly extending support segments at an upper location on said collet for mating and supporting said collet from said tubular member,
an upwardly-facing load shoulder above said support segments adapted to engage said downwardly-facing load shoulder,
radially outwardly-extending latches at the lower end of said collet engageable with said latch engaging means in the relaxed extended condition but not in the diametrically compressed condition, whereby said collet is engaged with said latch engaging means until said collet is compressed, said collet having a vertical flat on its outer diameter and having a radially inwardly-tapered portion therebelow,
said collet having a radially inwardly
extending, upwardly facing shoulder at the lower end engageable with said push shoulder;
the diameter of said vertical flat, said latch, said latch engaging means, said push shoulder and said inwardly-facing shoulder sized such that as said collet enters a casing and is diametrically reduced by squeezing the collet to the casing diameter the reduction of said vertical flat to the casing diameter produces a smaller diameter of said radially inwardly-facing shoulder than the diameter of said push shoulder and fully releases said engaging means; whereby said latch is disengaged as the taper below said vertical flat enters the casing and said push shoulder thereby engages said collet to push the collet down the casing to the support elevatation.

18. A casing hanger assembly as in claim 17 said casing hanger body having a tapered portion joining said first and second reduced diameter portions throughout substantially the entire differential diameter.

19. A casing hanger assembly as in claim 17 wherein said collet is formed of a cylindrical section having alternating part length slots from the top and bottom.

20. A casing hanger assembly as in claim 18 wherein said collet is formed of a cylindrical section having alternating part length slots from the top and bottom.

21. A casing hanger assembly as in claim 20 having,
alignment pins secured to said casing hanger body and passing through at least one of said slots open at the bottom,
slots in said casing hanger body through said load shoulder alignable with the slots in said collet which are open at the top,
said alignment pins and slots in the collet arranged so that the upper slots in the collet are aligned with the slots in the hanger body.

22. An apparatus as in claim 21 wherein alignment pins are located at a plurality of diametrically separated locations.

23. A casing hanger assembly as in claim 17 wherein said push shoulder is located below the inwardly tapered portion below said vertical flat of the collet when said collet is latched into engagement with said latch engaging means.

* * * * *